US006537489B2

(12) United States Patent
Allroth et al.

(10) Patent No.: US 6,537,489 B2
(45) Date of Patent: Mar. 25, 2003

(54) HIGH DENSITY PRODUCTS AND METHOD FOR THE PREPARATION THEREOF

(75) Inventors: Sven Allroth, Höganäs (SE); Björn Johansson, Höganäs (SE); Paul Skoglund, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/972,915

(22) Filed: Oct. 10, 2001

(65) Prior Publication Data

US 2002/0106298 A1 Aug. 8, 2002

Related U.S. Application Data

(63) Continuation-in-part of application No. 09/770,306, filed on Jan. 29, 2001, now abandoned, and a continuation of application No. PCT/SE01/01342, filed on Jun. 13, 2001.

(30) Foreign Application Priority Data

Nov. 9, 2000 (SE) ..... 0004122

(51) Int. Cl.[7] ..... B22F 3/08

(52) U.S. Cl. ..... 419/38

(58) Field of Search ..... 419/38

(56) References Cited

U.S. PATENT DOCUMENTS

| | | | | |
|---|---|---|---|---|
| 3,325,277 A | * | 6/1967 | Huseby | 75/0.5 |
| 3,811,878 A | * | 5/1974 | Chao et al. | 75/211 |
| 3,859,086 A | * | 1/1975 | Church et al. | 75/211 |
| 3,888,657 A | * | 6/1975 | Klar et al. | 75/0.5 B |
| 3,889,350 A | * | 6/1975 | Mocarski | 29/420.5 |
| 4,255,374 A | | 3/1981 | Lemcke et al. | |
| 5,154,881 A | | 10/1992 | Rutz | |
| 5,330,792 A | | 7/1994 | Johnson et al. | |
| 5,460,641 A | | 10/1995 | Åslund | |
| 5,744,433 A | | 4/1998 | Storström et al. | |
| 6,136,265 A | | 10/2000 | Gay | |
| 6,202,757 B1 | | 3/2001 | Dahlberg | |

FOREIGN PATENT DOCUMENTS

| | | |
|---|---|---|
| DE | 3742192 A1 | 7/1988 |
| WO | WO 94/02273 | 2/1994 |
| WO | WO 97/00751 | 1/1997 |
| WO | WO 99/36214 | 7/1999 |
| WO | WO 02/38315 A1 | 5/2002 |

* cited by examiner

*Primary Examiner*—Daniel J. Jenkins
(74) *Attorney, Agent, or Firm*—Burns, Doane, Swecker & Mathis, L.L.P.

(57) ABSTRACT

The present invention concerns a method of preparing PM products by high velocity compaction of iron or iron-based powers having irregular powder particles.

22 Claims, 2 Drawing Sheets

Figure 1:
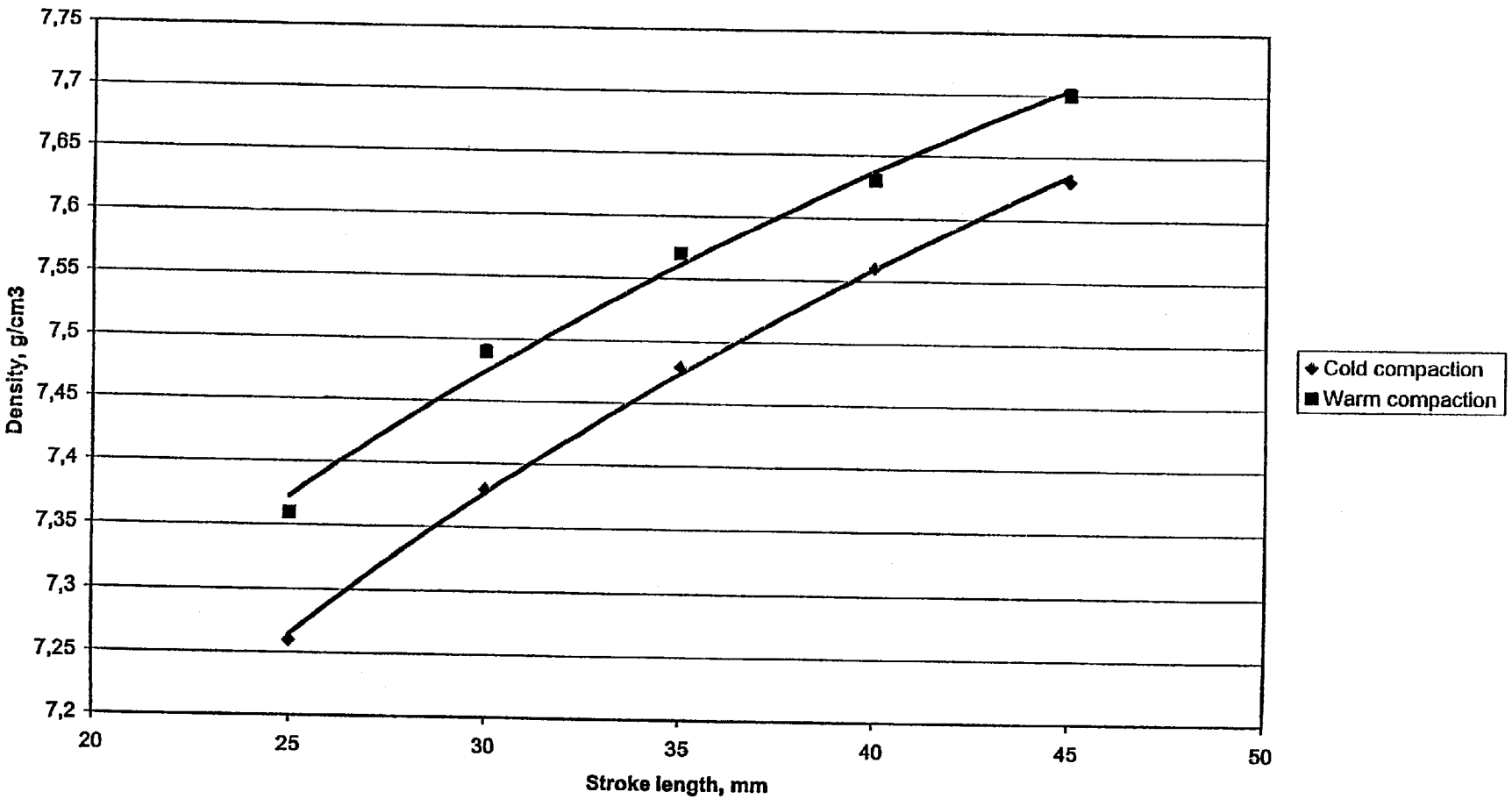

Density vs impact energy, expressed as stroke length in mm. Astaloy CrM

Measured and relative densities of M2

HIGH DENSITY PRODUCTS AND METHOD FOR THE PREPARATION THEREOF

This is a continuation-in-part of U.S. patent application Ser. No. 09/770,306, filed Jan. 29, 2001 and now abandoned; is a continuation of International Application No. PCT/SE01/01342 that designates the United States of America which was filed on Jun. 13, 2001 and was published in English on May 16, 2002; and claims priority for Swedish Application No. 0004122-8, filed on Nov. 9, 2000.

This invention relates to the general field of powder metallurgy and it is particularly concerned with high density products and a compacting operation for achieving such products.

As is well known the usual powder metallurgy practice employs raw materials in the form of powders suitably prepared, compacting such material by means of one of the various processes and then treating the product so obtained adopting suitable conditions of temperature, pressure and composition of the environmental atmosphere in order to obtain a product of desired characteristics. It is also well known to those skilled in the art that the final characteristics obtained remarkably depend on the density increase obtained by means of the forming operation.

A method of compacting metal or non-metal powders in order to increase the density and get compacts having a density of 92 to 98% of that of the solid body is the explosive compaction method. According to this method the powder is normally encapsulated in a can around which an explosive is placed. Some experiments have also been made in which a body was launched by explosion of the explosive to impact on the powder, whereby the speed of the body varied about 200 m/sec. The main advantage of this technique is that rods of high density can be produced, which, according to need, may have large dimensions without large capital expenditure. The method of compacting powder by using explosives is, however, not easy. It is not industrially used for mass production as it is not controllable. Furthermore, it can be dangerous for the operator.

A method and apparatus for doing away with the disadvantages of the explosive compaction method is disclosed in the U.S. Pat. No. 4,255,374. According to this patent the speed of the impact member relative to the powder to be compacted should be at least 300 m/s. However, no actual examples reporting results are given and, to the best of our knowledge, this method has not been accepted or used within the PM industry.

Industrially, there are currently different ways of achieving high densities, e.g. the composition of the metal powder may be changed, the compacting pressure may be increased, the compacting operation may be repeated or the compacting may be performed with a preheated powder or pre-compact in a heated die.

The U.S. Pat. No. 6,202,757 discloses a percussion machine. This machine is primarily intended for cutting metal rods but it is also stated that this machine might be used for the compaction of metal powders. It is suggested that the machine is adapted for compacting spherical, gas atomised powders. It is also stated that the compaction should be performed in several steps and that each step or stroke has a specific function. Thus it is taught that stroke 1 should be an extremely light stroke, stroke 2 should be a high-energy stroke and stroke 3 should be a stroke with medium high energy. There are however no examples demonstrating the effects of compaction of metal powders with the use of this machine. Nor does this patent state anything about the effects of such a compaction except that densities of 94–99% of the density of the corresponding homogenous material might be obtained if the compaction is performed in a spherical mould.

The WO publication 99/36214 discloses compaction of spherical metal powders with a compaction method which seems to be of the type described in the above U.S. Pat. No. 6,202,757. According to this known method a thermoreversible hydrocolloid, such as gelatine, is necessary as a binder in order to form the agglomerates of the powder particles before the compaction is performed. This WO publication also teaches that no significant effect has been seen regarding improvement in density or mechanical properties with powders having irregular particles. The highest green density which is obtained when compacting the agglomerates of these powders having spherical particles is reported to be 95.2% of the theoretical density. Only by subjecting the green bodies to a subsequent sintering step products having near full density are obtained.

In contrast to the teaching in the WO publication 99/36214 it has now been found that very high green densities can be obtained by subjecting iron powders or iron based powders having irregularly shaped particles to compaction with the aid of a percussion machine of the type disclosed in the U.S. Pat. No. 6,202,757. This type of compaction referred to as "high velocity compaction" or HVC in the following text is further described below.

According to the present invention and contrary to the teaching in the WO publication it has also been found that the powder particles should be subjected to the HVC compaction without preceding agglomeration of the powder particles with a thermoreversibe hydrocolloid such as gelatine. The use of a hydrocolloid in the manner disclosed in the WO publication would destroy the iron or iron-based powder by corrosion.

Water-atomised powders is a type of powder which have irregularly shaped particles and which preferably can be used according to the present invention. Another type of iron powder or iron based powder having irregularly shaped particles which can be used according to the present invention is sponge iron powder. Examples of such powders are pure iron powders, such as the water-atomised powder ASC 100.29. The pure iron powder could optionally be mixed with alloying elements such as phosphorus, copper, nickel, molybdenum, sulphur, chromium, manganese, vanadium, tungsten, cobalt etc. to a total amount of alloying elements of at most 20% by weight of the metal powder. Other iron-based powders which may be compacted according to this method are partially alloyed (diffusion alloyed) powders including the elements copper, nickel and molybdenum. The amount of copper may be up to 25 wt %, the amount of nickel may be up to 10 wt % and the amount of molybdenum up to 3 wt %. Another type of powders are fully pre-alloyed water-atomised powders including in addition to iron e.g. molybdenum, nickel, manganese and/or chromium. Also iron-based powders including a pre-alloyed base powder having elements such as copper, nickel and/or molybdenum diffusion annealed thereto may be used. So far, however, our results do not indicate that non-aggregated, spherical, gas-atomised powders generally can be HVC compacted to densities near theoretical density.

Before the compaction the powder may also be mixed with different particular additives selected from the group consisting of graphite, ferrophosphorus, hard phase materials, machinability enhancing agents, flow enhancing agents, lubricants. The graphite may be added in amounts up to 1% by weight of the powder in order to increase the mechanical properties. The powder fill can be performed as in conventional compaction.

The compaction may be performed in a lubricated die. Alternatively the iron or iron-based powder is mixed with a lubricant before compaction (=internal lubrication or bulk lubrication). It is also possible to use a combination of die wall lubrication and internal or bulk lubrication. Another alternative is to provide the powder particles with a lubricant coating or film before the compaction is performed. In this case the die walls may or may not be lubricated. Such a film may also be formed in situ during the compaction operation. The amount of lubricant required is at most 1% by weight, preferably less than 0.6% by weight and most preferably less than 0.3% by weight. The lubricant can be selected among conventionally used lubricants such as metal soaps, waxes and thermoplastic materials, such as polyamides, polyimides, polyolefins, polyesters, polyalkoxides, polyalcohols. Specific examples of lubricants are zinc stearate, H-wax® and Kenolube®. These lubricants may also be used for die wall lubrication.

In order to obtain the products having the desired high density according to the present invention the compacting method is important. Normally used compaction equipment does not work quite satisfactorily, as the strain on the equipment will be too great. It has now been found that the high densities required may be obtained by the use of the computer controlled percussion machine disclosed in the U.S. Pat. No. 6,202,757 which is referred to above and which is hereby incorporated by reference. Particularly, the impact ram of such a percussion machine may be used for impacting the upper punch of a die including the powder in a cavity having a shape corresponding to the desired shape of the final compacted component. When supplemented with a system for holding a die, e.g. a conventionally used die, and a unit for powder filling (which may also be of conventional type) this percussion machine permits an industrially useful method for production of high-density compacts. An especially important advantage is that, in contrast to previously proposed methods, this arrangement driven by hydraulics permits mass production (continuous production) of such high density components.

In the U.S. Pat. No. 6,202,757 it is stated that the use of the percussion machine involves "adiabatic" moulding. As it is not fully clarified if the compaction is adiabatic in a strictly scientific meaning we have used the term high velocity compaction (HVC) for this type of compaction wherein the density of the compacted product is controlled by the impact energy transferred to the powder.

According to the present invention the ram speed should be above 2 m/s. The ram speed is a manner of providing energy to the powder through the punch of the die. No straight equivalence exists between compaction pressure in a conventional press and the ram speed. The compaction which is obtained with this computer controlled HVC depends, in addition to the impact ram speed, i.a. on the amount of powder to be compacted, the weight of the impact body, the number of impacts or strokes, the impact length and the final geometry of the component. Furthermore, large amounts of powder require more impacts than small amounts of powder. Thus the optimal conditions for the HVC compaction i.e. the amount of kinetic energy which should be transferred to the powder, may be decided by experiments performed by the man skilled in the art. Contrary to the teaching in the U.S. Pat. No. 6,202,757 there is, however, no need to use a specific impact sequence involving a light stroke, a high energy stroke and a medium-high energy stroke for the compaction of the powder. According to the present invention the strokes (if more than one stroke is needed) may be essential identical and provide the same energy to the powder.

Experiments with existing equipment has permitted ram speeds up to 30 m/s and, as is illustrated by the examples, high green densities are obtained with ram speeds about 10 m/s. The method according to the invention is however not restricted to these ram speeds but it is believed that ram speeds up to 100 or even up to 200 or 250 m/s may be used. Ram speeds below about 2 m/s does, however, not give the pronounced effect of densification. It is preferred that the ram speed above 3 m/s. Most preferably the ram speed is above 5 m/s.

Furthermore the compaction may be performed at ambient or at elevated temperature e.g. between 90 and 180° C. In the latter case a pre-heated powder composition is subjected to compaction in a pre-heated die and the lubricant may be selected from lubricants specifically developed to this end. Examples of such warm compaction lubricants are disclosed in e.g. the U.S. Pat. Nos. 5,154,881 and 5,744,433.

Generally, the amount of lubricant used according to the present invention is small compared with conventional PM compaction methods and the density of the green compacts may be near pore free density, which is the highest possible density. The pore free density ($\delta_M$) is only theoretically achievable and this density (of a powder mix) can be calculated from the following formula:

$$\delta_M=100/(w_{Fe}/\rho_{Fe}+W_1/\rho_1+w_2/\rho_2+w_3/\rho_3+\ldots)$$

wherein $\rho_{Fe}$ is the specific weight of the iron powder (base powder), $w_{Fe}$ is the weight percentage of the iron powder, $\rho_1, \rho_2, \rho_3, \ldots$ are the specific weights of additives and impurities, $w_1, w_2, w_3, \ldots$ are the weight percentages of additives and impurities.

By using powers having irregularly shaped particles in combination with the HVC method it has been found that green compacts having a density above 98, and even above 99% of the theoretical (pore-free) density may be obtained, although the invention is not limited to the preparation of green compacts having such high densities. For pure iron powders and low alloyed iron powders this corresponds to densities above about 7.65 and even above 7.70 g/cm$^3$.

A particular advantage of the invention is that the compacts having near theoretical density may be sintered at low temperatures, such as 1120–1180° C. in conventional furnaces, such as belt furnaces. This is in contrast to conventional compaction methods where it is not possible to obtain such high green densities and where a high sintered density is obtained by high temperature sintering, which causes shrinkage of the compacts. By using the HVC compaction method with no or a very small amount of lubricant included in the powder composition to be compacted, the green density will be essentially identical with the sintered density. This in turn means that very good tolerances are obtained.

The invention is however not restricted to sintering at such low temperatures and by sintering at higher temperatures, such as up to 1400° C. even higher densities may be obtained.

Another important advantage of the method of the invention is that it provides a possibility of mass production of high density products being free from micro-cracks. The presence of micro-cracks is a particular big problem with high density products. In this case the powder particles, optionally in combination with particular additives such as graphite, ferrophosforus, hard phase materials, machinability improving agents, are provided with a lubricant coating or film. This coating or film is achieved by mixing the powder composition, which includes the free or loose, non agglomerated powder particles with the lubricant, subjecting the mixture to an elevated temperature for melting the lubricant and subsequently cooling the obtained mixture during mixing for solidifying the lubricant and providing the powder particles or aggregates thereof with a lubricant film or coating. Alternatively the particles are coated by dissolving the lubricant in an organic solvent, mixing the powder composition with the obtained solution and evaporating the solvent. The lubricant is preferably selected from those specified above. Before the compaction step the obtained powder mixture is admixed with a flow agent, such as Aerosil. A preferred coating method is disclosed in the WO publication 01/17716 which is hereby incorporated by reference.

The lubricant coating or film may also be provided by a lubricant which is liquid at room temperature or which melts in connection with the compaction operation, e.g. by heating the die. Another alternative to achieve the lubricant film around the metal particles is to use lubricants having such chemical and physical properties that the heat generated during the compaction operation is sufficient for melting the lubricant. The invention is not bound to any particular method of providing the lubricant coating or film.

In order to achieve high density products free from micro cracks according to the invention it is also essential that the amount of lubricant is low and preferably the amount of lubricant in the powder composition should be less than 1% of the powder composition. A suitable interval is between 1 and 0.005% by weight of the total composition. When the compaction is performed without die wall lubrication, the amount of lubricant in the powder is preferably between 0.8 and 0.01, most preferably between 0.8 and 0.2% by weight. The amount of lubricant in the powder composition could be even less by performing the compaction in a lubricated die and in this case the amount of lubricant in the powder composition preferably may vary between 0.4 and 0.01% by weight.

It has also been found that the method according to the present invention is well suited for manufacturing large compacts e.g. compacts having a weight above about 2 kg. Contrary to conventional compacting of such large components the method according to the present invention does not require large and expensive compaction equipment and the components may be manufactured in an industrially competitive way. Furthermore the invention is of particular importance for the preparation of compacts having simple geometry.

An unexpected finding is that the springback obtained with HVC compaction according to the present invention may be reduced to a considerable extent in comparison with the springback obtained with conventional compacting methods. The inventive method also permits the mass production or continuous production of compacts with small density variations within the compact.

In brief, some of the most important advantages which may be obtained by the method according to the present invention are high green and sintered densities, high density products without microcracks, sintering in conventional belt furnaces, mass production of high density components and mass production of large components.

The examples hereinafter, given non limitatively, describe the characteristics of the metallic powder, the lubricant used and the compaction method.

EXAMPLE 1

This example illustrates the possibility of preparing high density compacts without microcracks.

70 g of Distaloy DC1 which is a diffusion alloyed iron powder including 2% by weight of Ni and 1.5% by weight of Mo available from Höganäs AB, Sweden was used. This powder is manufactured by diffusion-annealing nickel to a molybdenum containing pre-alloyed base powder. The lubricant was Kenolube® and the coating was performed as described in WO publication 01/17716, which is hereby incorporated by reference. The powder mixture also included 0.6% by weight of graphite and 0.2 or 0.5% by weight of Kenolube depending on if the compacting operation was performed with die wall lubrication (abbreviated "DWL" in the following table 1). The powder composition also included 0.03% of Aerosil® as flow enhancing agent.

The compaction was carried out with the aid of a percussion machine (Model HYP 35–4 from Hydropulsor Sweden) of the type described in U.S. Pat. No. 6,202,757. The maximum nominal impact energy was 4000 Nm, which expressed as stroke length, corresponds to 90 mm.

The ram speed was approximately 10 m/s.

TABLE 1

| | Without coating | | With coating according to the invention | |
|---|---|---|---|---|
| | (0.5%) * | (0.2%) * | (0.5%) * | (0.2%) * |
| Density % of theor. | No DWL | DWL | No DWL | DWL |
| 95% | No micro-cracks | No micro-cracks | No micro-cracks | No micro-cracks |
| 96% | Some micro-cracks | Some micro-cracks | No micro-cracks | No micro-cracks |
| 97% | Frequent micro-cracks | Micro-cracks | No micro-cracks | No micro-cracks |
| 98.5% | Frequent micro-cracks | Frequent micro-cracks | No micro-cracks | No micro-cracks |

* amount of lubricant(Kenolube) in % by weight of the powder composition
DWL = die wall lubrication The theoretical densities of the powder compacts were:

Distaloy DC1+0.6C+0.2% Kenolube=7.66 g/cm$^3$

Distaloy DC1+0.6C+0.5% Kenolube=7.52 g/cm$^3$

EXAMPLE 2

This example illustrates the possibility of preparing compacts having near theoretical density and that the compaction can be performed with internal lubrication and with die wall lubrication, respectively. The example also discloses that Stellite F, which is a gas-atomised powder having spherical particles, cannot be compacted according to the method of the present invention. The compacting was performed with the aid of a percussion machine Model HYP 3015 from Hydropulsor AB, Sweden. The stroke length was 40 mm corresponding to a ram speed about 5.5 m/s.

The results of the HVC pressing are summarised in table 2.

TABLE 2

| Material | Kinetic energy Nm | Number of impacts | Lubrication | Density g/cm$^3$ | Rel. Density g/cm$^3$ |
|---|---|---|---|---|---|
| Stellite F* | 1280 | 5 | Lubr. die | *** | *** |
| ASC 100.29** | 1280 | 5 | Lubr. die | 7.80 | 99.4 |
| ASC 100.29** | 1280 | 5 | 0.3% ZnSt**** | 7.68 | 98.1 |
| ASC 100.29** | 1280 | 5 | 0.6% ZnSt**** | 7.53 | 95.7 |

*Gas-atomised Co powder available from Isotec
**Pure Fe, water-atomised powder available from Höganäs AB, Sweden
*** too low density, not possible to measure
****zinc stearate added to the powder before compaction The compacts were sintered at 1120° C. for 30 minutes in an atmosphere of 90% nitrogen and 10% hydrogen. The results summarised in Table 3 were obtained:

TABLE 3

| Material | Density g/cm$^3$ |
|---|---|
| ASC 100.29 | 7.79 |
| ASC 100.29 | 7.68 |
| ASC 100.29 | 7.54 |

The comparatively low difference in green and sintered densities makes it possible to get narrow dimensional change tolerances.

EXAMPLE 3

This example demonstrates cold and warm HVC compaction of a water atomised, pre-alloyed powder. The powder was ACrM, which is a low alloyed powder available from Höganäs AB and which contains 3% by weight of Cr and 0.5% by weight of Mo. As can be seen from FIG. 1 very high densities can be obtained with both cold and warm compaction at high impact energies. The maximum theoretical density is 7.82 g/cm$^3$.The compaction was carried out with the aid of a percussion machine (Model HYP 35-4) as above. The stroke lengths between 25 and 45 mm correspond to ram speeds between 4.5 and 6 m/s.

EXAMPLE 4

This example illustrates the possibility of preparing compacts from a water-atomised powder having relatively high amount of alloying elements. Also this powder can be compacted to near theoretical density by the inventive method. The powder used, M2 available from Powdrex Ltd, UK, had the following composition (% by weight):

TABLE 4

| Material | C | Cr | Fe | Mo | W | V | Co |
|---|---|---|---|---|---|---|---|
| M2 | 0.78 | 4.29 | Base | 5.23 | 6.62 | 1.78 | 0.39 |

The compaction was performed in a lubricated die and carried out with the aid of a percussion machine (Model HYP 35-4. The following results were obtained:

TABLE 5

| Compaction method | Density (g/cm3) | Theor. density g/cm3 | % of theor. density | Impact energy expressed as stroke length (mm) |
|---|---|---|---|---|
| HVC according to invention | 7.70 | 7.93 | 97.1 | 100 |
| 800 MPa conv. Compaction | 6.85 | 7.93 | 86.4 | |

Figure 2:
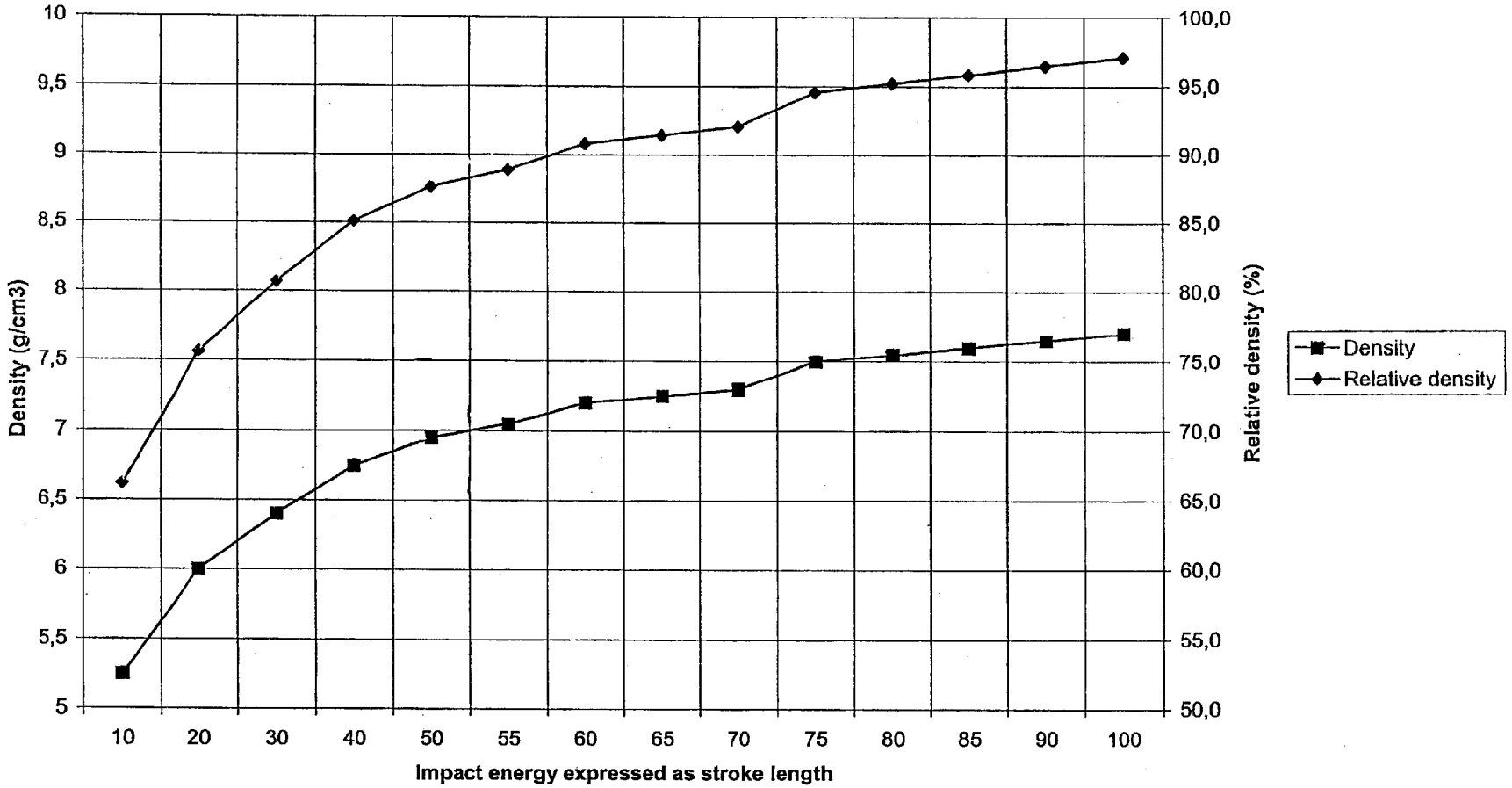

The influence of the stroke length (i.e. the distance between the surface of the powder to be compacted and the surface of body of the impact ram which strikes the punch in its upper position) on the measured and relative density is illustrated by FIG. 2. The stroke lengths correspond to ram speeds between 2 and 9.5 m/s.

What is claimed is:

1. A method of preparing PM products, comprising the steps of:

filling a mould with a powder having irregular powder particles, said powder being selected from the group consisting of alloyed iron-based powders and essentially pure iron powders;

subjecting the powder to HVC compaction with an uniaxial pressure movement at an impact ram speed above 2 m/s;

releasing the obtained compact from the mould, the obtained compact being free of micro-cracks; and optionally sintering the obtained compact.

2. A method according to claim 1 characterised in that the iron powder or iron based powder is a water-atomised powder.

3. Method according to claim 1 characterised in that the alloyed iron based powder is a diffusion alloyed powder, a pre-alloyed powder or a diffusion annealed pre-alloyed powder.

4. Method according to claim 1 characterised in that the powder before compaction is mixed with one or more additives.

5. Method according to claim 1 wherein the additive is selected from the group consisting of graphite, ferrophosphorus, hard phase materials, machinability enhancing agents, flow enhancing agents, and lubricants.

6. Method according to claim 1 characterised in that the compaction is performed in a lubricated mould without internal lubricant.

7. Method according to claim 1 characterised in that the compaction is performed with a powder including at most 1% by weight of a lubricant.

8. Method according to claim 1 characterised in that the powder particles or aggregates thereof are coated with a lubricant.

9. Method according to claim 1 characterised in that the compaction is performed at a ram speed above 3 m/s.

10. Method according to claim 1 characterised in that the compaction is controlled by the impact energy transferred to the powder.

11. Method according to claim 1 characterised in that the compaction is performed as warm compaction.

12. Method according to claim 1 for the preparation of compacts having a density above about 96% of the theoretical density.

13. Method according to claim 1 for the preparation of compacts having a density above about 98% of the theoretical density.

14. Method according to claim 2 characterised in that the sintering is performed in a belt furnace at temperatures below 1250° C.

15. Method according to claim 2 for the preparation of large components.

16. Method according to claim 2 for mass production of high density components.

17. Method according to claim 2 characterised in that the alloyed iron based powder is a diffusion alloyed powder, a pre-alloyed powder or a diffusion annealed pre-alloyed powder.

18. Method according to claim 1 characterised in that the compaction is performed at a ram speed above 5 m/s.

19. Method according to claim 2 characterised in that the sintering is performed in a belt furnace at temperatures below 1200° C.

20. Method according to claim 2 characterised in that the sintering is performed in a belt furnace at temperatures below 1160° C.

21. A method of preparing PM products, comprising:

filling a mould with a water-atomized powder or a sponge iron powder, the powder being an alloyed iron-based powder or an essentially pure iron powder;

subjecting the powder to HVC compaction with an uniaxial pressure movement at an impact ram speed above 10 m/s;

releasing the obtained compact from the mould, the obtained compact having a density of at least 96% of the theoretical density and being free of micro-cracks; and optionally sintering the obtained compact.

22. A method of preparing PM products, comprising:

filling a mould with a water-atomized powder or a sponge iron powder, the powder being an alloyed iron-based powder or an essentially pure iron powder;

subjecting the powder to HVC compaction with an uniaxial pressure movement at an impact ram speed above 2 m/s using at least one stroke, each stroke providing the same energy to the powder;

releasing the obtained compact from the mould, the obtained compact being free of micro-cracks; and optionally sintering the obtained compact.

* * * * *